US005931312A

United States Patent [19]

Gifford

[11] Patent Number: 5,931,312

[45] Date of Patent: Aug. 3, 1999

[54] PRODUCE SIZING AND SORTING MACHINE

[76] Inventor: Dennis W. Gifford, 1208 Middlesex, Salt Lake City, Utah 84123

[21] Appl. No.: 08/876,306

[22] Filed: Jun. 16, 1997

[51] Int. Cl.[6] ..... B07B 13/05

[52] U.S. Cl. ..... 209/665

[58] Field of Search ..... 209/665, 667, 209/660, 659, 673, 675, 681, 307

[56] References Cited

U.S. PATENT DOCUMENTS 1,968,939 8/1934 Grabill ..... 209/665
2,618,306 11/1952 Magnuson ..... 209/665 X

FOREIGN PATENT DOCUMENTS 423149 1/1935 United Kingdom ..... 209/665

*Primary Examiner*—David H. Bollinger
*Attorney, Agent, or Firm*—K. S. Cornaby

[57] ABSTRACT

A sizing device is described using traveling conveying spool rollers. The rollers are of a configuration using various openings that allow the produce to be sized as to shape or cross section diameter. Rollers are constructed of a plastic polymer with a very low friction coefficient, thus avoiding the scuffing damage to the produce. The variant surface speed of the spools encountered by the produce coupled with the speed of the whole creates movement of the produce which assures that the size openings are available and encountered by the undersized pieces.

7 Claims, 3 Drawing Sheets

PRODUCE SIZING AND SORTING MACHINE

BACKGROUND OF THE INVENTION

This invention relates to a device for sorting and sizing produce. A wide variety of machines have been used to size produce such as a screen conveyor constructed with holes of a designated diameter to allow the undersized produce to fall through. The problems are the screen has a short life as the holes stretch, wear rapidly, require a shaking and bouncing to dislodge the larger produce from occupying the available holes necessary for separation. Elongated produce will not rotate to fall through if not bounced and shaken.

Several attempts have been made to remedy the situation. The Milestone (U.S. Pat. No. 3,721,345) screw sizer uses lateral rotating screws that have the ridges substantially aligned. The produce considered too small are supposed to fall through the open holes, as the potatoes travel or are conveyed across the deck of rotating screws.

A major problem with this arrangement is that the deck is not large enough to separate the small potatoes and to allow them time to find an unoccupied hole to fall through. The screw action shown in the patent drawing needs just seven rotations to convey from start to end. The individual screws, which all rotate sideways, tend to move the potatoes to the side. This action does not separate, but bunches the potatoes to the side to flow off the deck in mass, not separated. Each screw has a long opening the length of the screw, thus the opening is not round and cannot adhere to a specific size such as a 2 inch diameter. The screws are supported with a bearing at both ends, and not cantilevered. The length of travel across the bed, while maintaining a space between the screws, cannot be increased substantially.

The rotation energy of motion of the screw is not concentrated towards the opening, but directional, as evident by the movement toward two different right angle paths. This disrupts the rotation movement necessary to align oblong potatoes to a vertical position directly on an open hole.

A traveling expanding roll sizer has rollers which expand the space between the rollers as they travel over a takeaway belt. This allows for the larger diameter produce to travel further. The problem is oval shaped produce has narrow ends and a considerably wider cross section, thus for example a round fat potato is carried farther than a long thin potato, but with a weight of much less.

A stationary spool sizer is a series of stationary shafts providing spools with rotational motion, but no forward motion. The problems here are that the holes acquire produce that is discharged neither by passing over nor falling through, thus the plugged holes soon limit the separation ability and many undersigned pieces carry over. The spools are constructed of a rubber material to which mud and rot readily adheres. The produce is often damaged because when one spool is rotating down the next is rotating up. If the down rotation spool finds a high friction surface and the up rotation spool has a low friction surface the produce is pinched, broken or squashed through the hole.

A star table is a series of rotating shafts which can be adjustable as to space between the shafts and as to rotational speed. The star is constructed of soft rubber. The produce articles are hit by the rotating stars; the large articles are lifted and the soft dirt is broken; the small articles that miss the flailing of the rubber stars will fall through the opening. The problems are the openings are not round, therefore adjusting the width between the shafts provides only a hit and miss as to how many one can allow to fall through.

Accuracies are not possible due to the majority of produce being round in shape rather than square. The separation accuracies are less than 50%, most probable only 25% of undersize will fall through and 75% will carry over. To achieve the levitation needed one must rotate the shafts fast enough for the stars to hit the larger produce hard enough and often enough to allow the smaller size produce to slip through. In the slapping effect, even with the soft rubber stars, a slight disappearance of the skin or net happens each time the produce is struck. The effect on freshly harvested produce, such as potatoes, which are not fully matured, if slapped long and hard enough in the abrasion of dirt and sand, will remove all the skin. If the potato has a low pulp temperature such as in storage, any drop or impact will cause considerable damage, and more so as the pulp temperatures are reduced below 45 degrees F.

An electronic weight sizer or an electronic profile, although accurate, is very expensive and requires an environment not available in the field. The produce to be sized by weight or profile first has to be measured one piece at a time, thus the volumes to be separated are limited. Dirt, rocks and dust would surely damage the electronics.

SUMMARY OF THE INVENTION

The need for a sizer capable of large volume separation of undersized produce with little damage to large size during harvest is needed. A sizer that can operate with dirt, rot, rocks, etc. does not presently exist. With a traveling bed of ultra high molecular weight (UHMW) polymer such as polyethylene, spools can be inexpensively constructed using the shapes required to size many different objects. The forwardly conveying motion allows large volumes of produce to cross. The rotational motion of a lateral spool with the inherent variation of the surface speed of the spool transmits motions that will move objects of different sizes and shapes in randomness without the use of shaking or bouncing. The alignment of elongated produce directly over a hole is achieved by using the inherent surface speed of rotating spools. The surface spool speed of the spool valley is much less than the surface speed of the ridge. The low friction of a plastic will wear well, but mud will not readily adhere to the surface and the produce to be sized will not be scuffed or damaged.

The Kinetic Energy of Motion $$E=\frac{1}{2} MV^2$$

Kinetic energy is the energy that an object has because of its motion. Kinetic energy is organized, coherent motion. Thus the Kinetic Energy of Motion is predictable and controllable. The directional and or rotational motion transferred to objects of like density, but different size, will result in vastly different levels of kinetic energy.

In an example using potatoes which vary in size from 1 oz. to 30 oz., the potatoes are conveyed across the traveling spools, and all are rotated 4 times a second. The kinetic energy transferred to the potatoes would indeed be quite different as to weight.

2 oz. potato×½ the mass×velocity squared=16

8 oz. potato×½ the mass×velocity squared=64

16 oz. potato×½ the mass×velocity squared=128

The larger potatoes have obtained much more energy than the smaller potatoes. The rotational motion is imparted equally to both the large and small potatoes and would cause the potatoes with more energy to rise, and the potatoes with less to migrate down. The rotating spools with holes at the bottom further rotate the potatoes so a 4 oz. potato that has a diameter of 2 inches and a length of 4 inches will be rotated until it falls with ease through the 2 inch holes at the bottom.

THE DRAWING

A preferred embodiment of the invention is illustrated on the accompanying drawings, in which:

FIG. 1 shows a side view of a sorting device utilizing a sorting bed of the invention;

FIG. 2, a sectional view of the device shown in FIG. 1 along the line 2—2;

FIG. 3, shows a detailed view of a preferred embodiment of a sorting roller of the invention.

DETAILED DESCRIPTION OF PREFERRED EMBODIMENT

Figure 1:
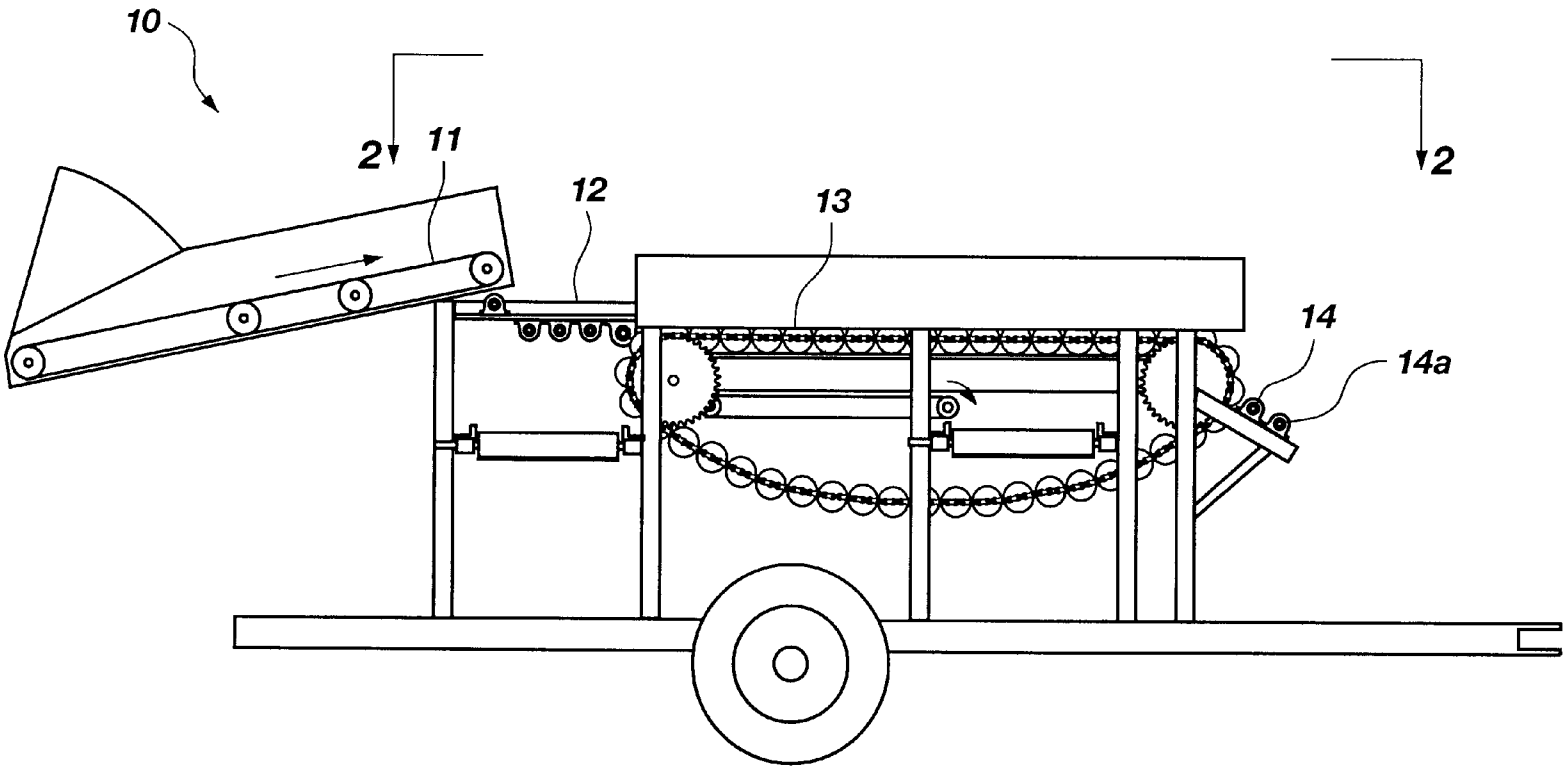

The flow of the invention is described in FIG. 1. In a sorting device (10) a delivery conveyor (11) discharges the produce to be sized onto a star bed. The stars (12) rotate from start to finish at increasing rotational speeds. The spools (13) also increase the rotational movement of the produce while also increasing the forward speed. The rear discharge conveyor (14) accepts the produce articles as they leave the spools (13) and land on rubber stars **(14*a*)** which cushion, slow and absorb the kinetic energy acquired during their movement across the sorting device.

Figure 2:
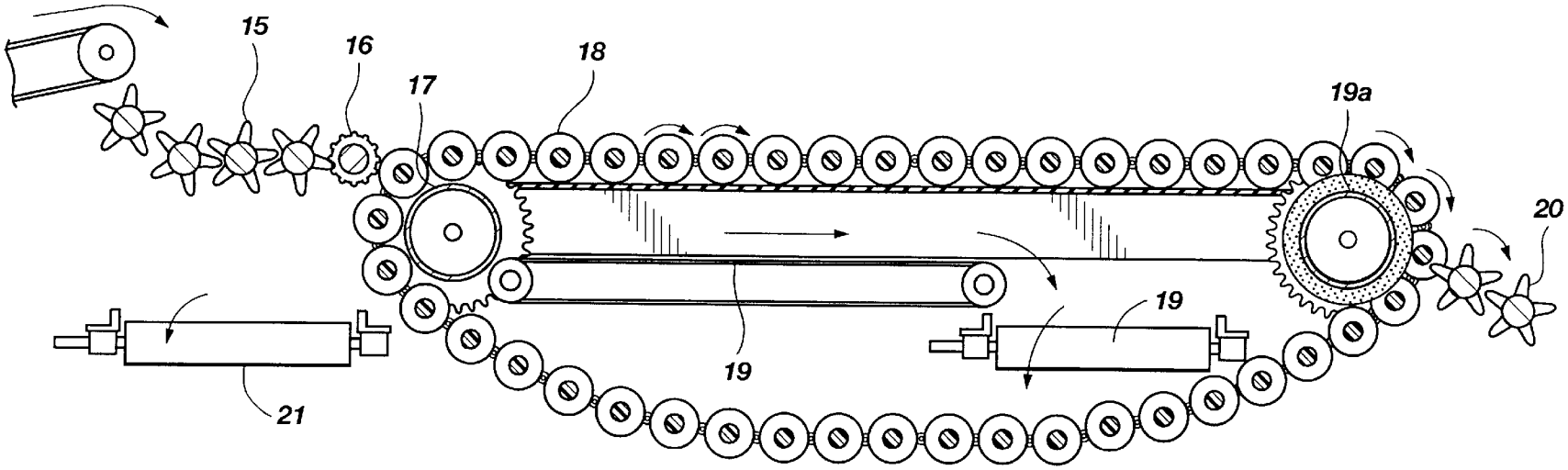

In FIG. 2, the stars (15) allow dirt and debris to fall through to a side conveyor (21) to be discharged. The stars (15) rotate and set all produce in motion. The produce, while flowing across the stars, which rotate at increasing speeds, acquire more kinetic energy. At this point all produce are in independent motion. Thus, the large produce with more mass acquire more energy of motion than the smaller produce. Thus, the large produce with more energy of motion rotate and move in this flow much like the heat currents of a liquid and rise or separate from the smaller produce which have less mass and consequently less energy. During the transition from the stars (15) to the spools (18), the spool openings are all available for small produce to fall through. Transition spools (16) show that no drop is needed from the stars (15), and the forward flow to the spools (18) is not interrupted. The drum (17) shows its relationship to the spools (18). The drum (17) prevents any loss of small produce having passed through the spools (18) at this point. The produce products are rotated on the drum (17) with the drive of the spools (18), which allows the small produce to fall on to the takeaway conveyors (19) and to be discharged. The produce will experience a further acceleration of rotation as they continue along the rotating spools (18). The produce will be rotated in every direction to align with the spool openings and fall through.

A drum covered with sponge rubber **(19*a*) rotates at the same speed as the forward motion of the spools (18). The produce shaped like a pear, the small part sticking down and through the spool (18), the large part too large to fall through, are lifted by the sponge rubber so as to exit the spool (18) and be discharged to rotating stars (20). The stars (20)**, being of molded rubber, slow, cushion and absorb the acquired speed or the kinetic energy gained during the flow across the machine, thus preventing the produce from damage.

Figure 3:
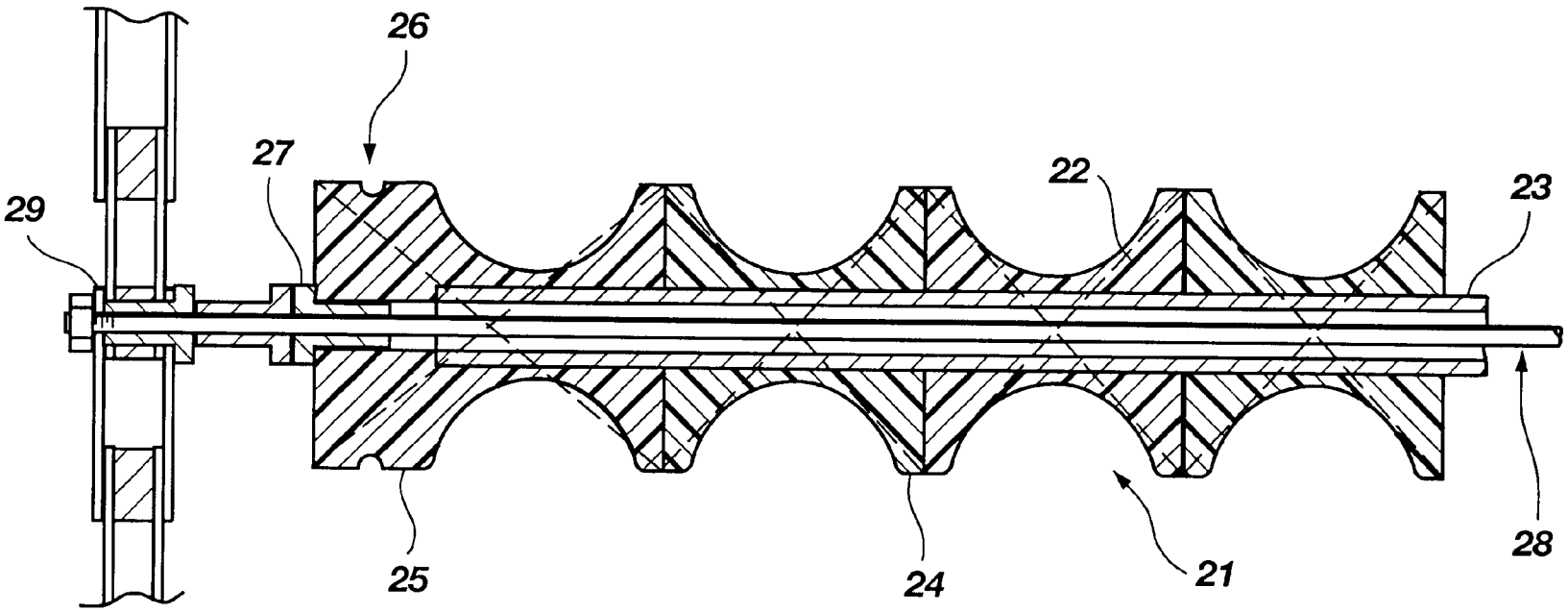

FIG. 3 describes the construction of the spool string (21). It is constructed preferably of UHMW polyethylene which is a plastic polymer that is resistant to abrasion. The inner spools (22) of the string are machined of UHMW to a desired outer size. The spools are pressed on a metal tube (23). The inner hole of the spool is slightly smaller and gains tension when pressed on the metal tube (23). This tension creates a bridge (24) that runs from ridge to opposite ridge the entire length of the spool string (21). A force encountered in the center of the spool string (21) is transmitted throughout the length of the spool string (21). The weight of the produce on the center is also transmitted to the ends. The end spool (25) with O ring grooves (26) allows for an O ring to transmit friction and traction so as to assure rotation of the spools (21) on their forward travel. The end spool (25) is also pressed on the tube (23) with a nylon bearing bushing (27) at one end. A rod (28) runs through the spools and is attached to the hollow pin roller chain (29) at both ends. The rod (28) is bolted to the hollow pin roller chain (29) so as not to rotate. The nylon bushing bearing (27) pressed on the end spool allows the spool string to rotate only on the rod (preferably of stainless steel) and the bushing bearing. The nylon bushing bearing (27) is inexpensive and also easily replaced when worn.

While this invention has been described and illustrated herein with respect to preferred embodiments, it is understood that alternative embodiments and substantial equivalents are included within the scope of the invention as defined by the appended claims.

I Claim:

1. A device to separate produce as to diameter size using motion that continues increasing the kinetic energy of the produce to effectuate different kinetic energy levels of the produce of random mass size of like densities comprising the following:

a bed of rotating rubber star shafts to impart forward motion to articles of produce thereon, said stars rotating faster as the produce crosses to drop onto a rotating spool conveyor;

a rotating spool conveyer having apertures between a series of rotating spools at the bottom thereof to allow a desired smallest size article of produce to rotate and align directly over an exact diameter opening to be discharged from the mass flow of the articles of produce;

a metal drum independently rotating in harmony inside a rearward drive of said spool conveyer to rotate small produce articles to a discharge conveyor;

a sponge drum independently rotating in harmony inside a forward drive of said spool conveyer to lift and dislodge certain undersized produce from the spools; and a driven discharge rubber star bed damper to slow the produce and absorb the acquired speed of produce articles before discharge, said damper positioned at the rear discharge end of said rotating spool conveyor.

2. A driven rotating bed of stationary star rubber shafts as set forth in claim 1, which are all driven at increasing rotational speeds.

3. A spool conveyer shaft as set forth in claim 1, which is constructed of a low friction material to provide for different size openings to allow produce to fall through.

4. A rotating star discharge bed as set forth in claim 1, which absorbs and dampens the speed of the produce before discharge from the conveyor, said stars being driven to rotate in time with the lower diameter of the spools.

5. A metal drum as set forth in claim 1, for rotating in harmony inside the rear drive of the spool conveyer to rotate small produce to a take away conveyor.

6. A sponge drum as set forth in claim 1, which rotates in harmony inside the forward drive of the spool conveyer to lift and dislodge the partly undersize produce from the spools.

7. A spool conveyor shaft as set forth in claim 1, which is constructed of UHMW polyethylene.

* * * * *